US007035169B2

(12) United States Patent
Gonzalez

(10) Patent No.: US 7,035,169 B2
(45) Date of Patent: Apr. 25, 2006

(54) EVENT PLANNER TIMEPIECE

(75) Inventor: Julien Gonzalez, Bulle (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 249 days.

(21) Appl. No.: 10/626,665

(22) Filed: Jul. 25, 2003

(65) Prior Publication Data

US 2005/0078560 A1 Apr. 14, 2005

(30) Foreign Application Priority Data

Jul. 25, 2002 (CH) ..... 1308/02

(51) Int. Cl.
*G04B 23/02* (2006.01)
*G04C 21/00* (2006.01)
*G04C 23/00* (2006.01)

(52) U.S. Cl. ..... 368/73; 368/251

(58) Field of Classification Search ..... 368/240–242, 368/223, 73, 246, 250, 251, 244, 41, 110–112
See application file for complete search history.

(56) References Cited

U.S. PATENT DOCUMENTS

| | | | | |
|---|---|---|---|---|
| 4,905,213 | A * | 2/1990 | Masse et al. | 368/10 |
| 5,199,009 | A * | 3/1993 | Svast | 368/240 |
| 5,892,455 | A * | 4/1999 | Matsumoto | 340/7.55 |
| 5,910,931 | A * | 6/1999 | Pettyjohn | 368/251 |
| 6,272,076 | B1 * | 8/2001 | Dinger | 368/15 |
| 6,414,907 | B1 * | 7/2002 | Pennington | 368/10 |
| 6,449,219 | B1 * | 9/2002 | Hepp et al. | 368/16 |
| 6,556,222 | B1 * | 4/2003 | Narayanaswami | 715/786 |

FOREIGN PATENT DOCUMENTS

| | | |
|---|---|---|
| DE | 298 00 650 U1 | 12/1998 |
| DE | 199 11 008 A1 | 9/2000 |
| EP | 0 984 342 A1 | 3/2000 |
| EP | 1 247 589 A1 | 10/2002 |
| FR | 2 583 895 A1 | 12/1986 |
| JP | 58140669 | 8/1983 |
| WO | WO 87/00309 | 1/1987 |
| WO | WO 01/05689 A1 | 1/2001 |
| WO | WO 01/09689 A1 | 2/2001 |
| WO | WO 02/09490 A1 | 2/2002 |

OTHER PUBLICATIONS

European Search Report, dated May 8, 2003.
The Delphion Integrated View for DE19911008A1, downloaded from www.delphion.com on Jul. 28, 2005, 2 pages.
Derwent Record for DE19911008A1, downloaded from www.delphion.com on Jul. 28, 2005, 2 pages.

* cited by examiner

*Primary Examiner*—Andrew H. Hirshfeld
*Assistant Examiner*—Leo T. Hinze
(74) *Attorney, Agent, or Firm*—Griffin & Szipi, P.C.

(57) ABSTRACT

The present invention relates to an electronic timepiece, of the wristwatch type, for providing information relating to an event comprising a plurality of scheduled events, like for example the Olympic Games, the football World Cup, or the public holidays across the world. The timepiece includes in particular a control circuit comprising storage means in which there is stored data relating to the scheduling of the plurality of scheduled events and comparison means for comparing the data stored with a time-related piece of information, the control circuit activating indicator means for designating one or more events in response to a control signal from comparison means.

16 Claims, 7 Drawing Sheets

EVENT PLANNER TIMEPIECE

This application claims priority from Swiss Patent Application No. 2002 1308/02, filed Jul. 25, 2002, the entire disclosure of which is incorporated herein by reference.

FIELD OF THE INVENTION

The present invention relates to an electronic timepiece, of the wristwatch type, supplying information related to an event comprising a plurality of scheduled events, like, for example, the Olympic Games, the football World Cup, or even public holidays across the world.

BACKGROUND OF THE INVENTION

There is known in the prior art, from German document No. DE 199 11 008, a wristwatch, shown in FIG. 1, with a circular watchcase 101, a circular bezel 102, and a glass, the latter being secured by the bezel. A dial 104 is located under the watch glass, held by a truncated flange 105, on which the hours from "1" to "12" are marked. At the centre of dial 104, there is an opening through which the four arbours carrying the hands pass, of which only outer arbour 106 is visible in the Figure. The arbours are connected to the watch movement, not shown, placed under dial 104. Each of the four arbours carries one of the four hands, hour hand 107, minute hand 108, second hand 109, and additional hand 110 rotating anticlockwise.

Bezel 102 is divided into 12 parts, in each of which there is an indication of one of the months. The indication for the month of January is placed between 11 and 12 o'clock; the indication for the month of February is placed between 10 and 11 o'clock, and so on until the December indication, which is placed between 12 o'clock and 1 o'clock.

Additional hand 110 is driven by the watch movement so as to complete one revolution of dial 104 in one year passing through 52 positions, which corresponds approximately to a displacement at a rate of one step per week.

On dial 104, the 17 dates corresponding to the 17 Grand Prix of the 1999 Formula One season are shown, as well as the countries in which the Grand Prix take place. The various indications concerning the countries are radially marked on the periphery of dial 104 facing dates, the indications relating to the dates being marked in spaces that are also shown on the periphery of the dial.

Thus, during the week in which a Grand Prix takes place, additional hand 110 indicates the country and the date. The user can thus check whether the date of the day corresponds to the date indicated and know whether the Grand Prix is taking place on the day in question, since the Formula One Grand Prix always takes place on a Sunday, the user can also check the day of the week. For this type of information, the indication given by additional hand 110, accurate to within a week, is thus just sufficient.

Since there is no Grand Prix from November to February, this sector of dial 104 is left blank in order to mark "Formula One 1999".

Watchcase 101 includes a crown 111 arranged at 3 o'clock, particularly for setting the time, and a pushbutton 112 arranged at 2 o'clock, for setting additional hand 110 to the correct date.

A watch of this type has, however, several drawbacks. Indeed, it is important to note that the additional hand first of all provides a time indication, which corresponds to the markings concerning, for example, the place of the event.

Consequently, the position of the additional hand depends solely upon the date, and more precisely of the week in progress. Thus, the additional hand may only indicate a single marking, for example a country, in a sure manner. It thus does neither allow indication of several simultaneous events, nor several indications of the same nature concerning an event taking place.

The idea that would consist in using several additional hands has no advantage, given that there is a direct correspondence between the position of the additional hand and the week in progress. Thus, in order to be able to indicate two events by means of two additional hands, it would be necessary form them to provide different time indications, which would make reading virtually impossible.

Moreover, it is also to be noted that the additional hand only indicates the coming of an event to within one week. The user is then obliged to compare the date indicated by the additional hand with that of the current day in order to check the actual coming of the event indicated. This being so, the user, if he wishes to know the start time of the indicated event in order to follow, for example, a live television broadcast, he has to know the start time of the event at the place in which he is located. This requires knowing the start time of the event in the country in which it is taking place and the place where the user is located. It is thus not very easy to be able to use this watch to obtain precise information as to the coming of an event.

Finally, such a watch can only be used for one Formula One season. Indeed, from year to the next, the dates change for each Grand Prix, and the calendar order can undergo some modifications, as well as the addition or omission of certain Grand Prix.

It is thus an object of the invention to provide a timepiece that is capable of indicating a plurality of simultaneous events in a precise manner.

The electronic timepiece according to the invention is characterised in that it allows the aforementioned drawbacks to be overcome.

SUMMARY OF THE INVENTION

Thus, the present invention concerns an electronic timepiece that includes, in particular:

- a time base for delivering a first time-related piece of information;
- first indicator means for said first time-related piece of information;
- non time-related indications/symbols of the same nature relating to a plurality of scheduled events, connected to each other;
- second indicator means capable of simultaneously designating several non time-related indications relating to one or more events occurring from among said plurality of scheduled events,
- a control circuit including storage means in which is stored data relating to the scheduling of said plurality of events and comparison means for comparing said stored data with a time-related piece of information, said control circuit activating said second indicator means in response to a control signal from said comparison means.

According to one embodiment of the invention, the electronic timepiece is characterised in that said time base delivers a second time-related piece of information independent of the time zones, and in that said plurality of events is scheduled as a function of this second time-related piece of information.

According to another embodiment of the invention, the electronic timepiece is characterised in that said time base further includes reception means for external signals in order to download said data relating to the scheduling of said plurality of events from a specific site of a wide computer network.

The invention will be explained in detail hereinafter for embodiments given solely by way of example, these embodiments being illustrated by the annexed drawings, in which:

BRIEF DESCRIPTIONS OF THE INVENTION

FIG. 1, already described, shows a "Formula One" watch according to the prior art;

DETAILED DESCRIPTION OF THE INVENTION

Figure 2:
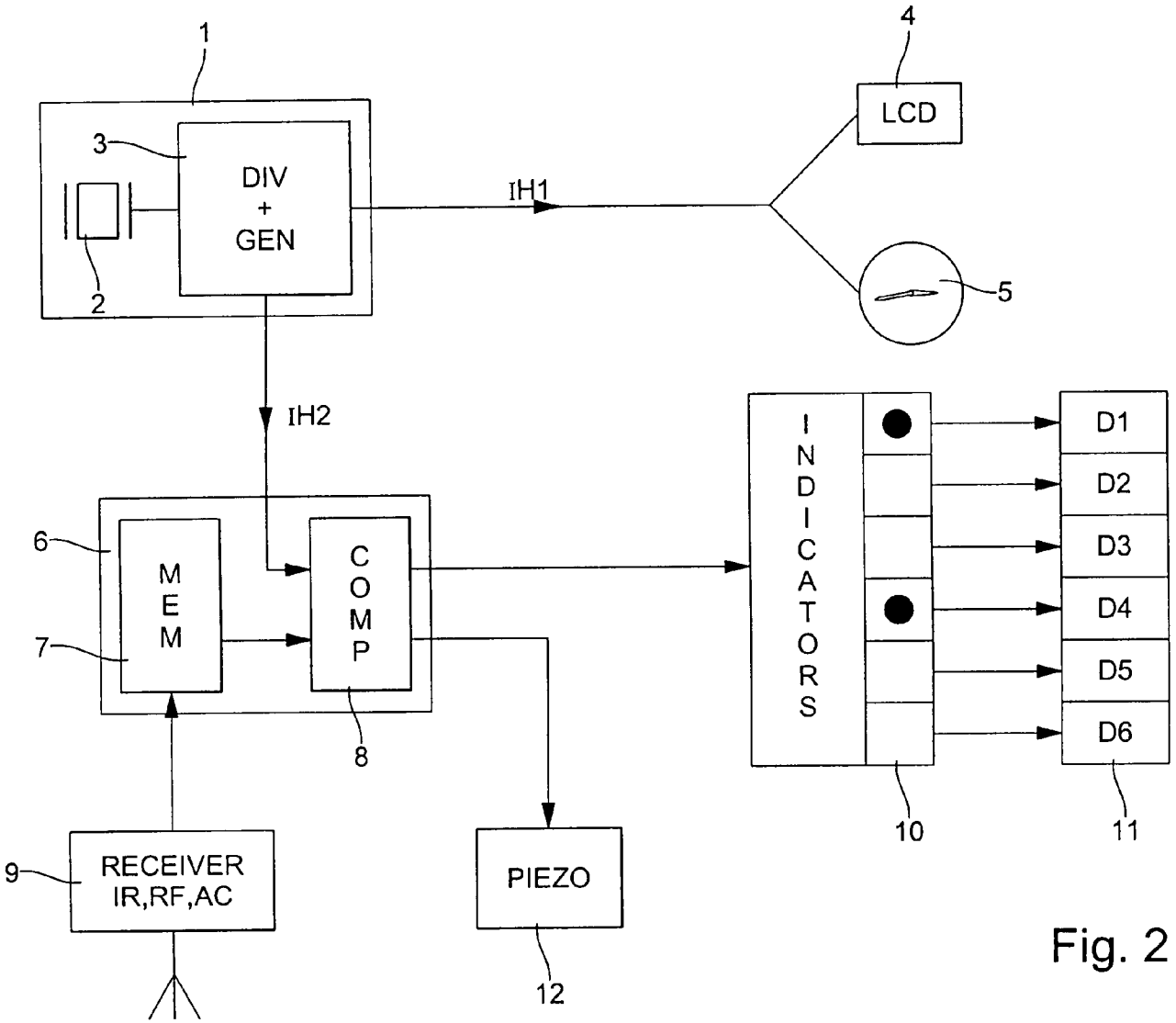
FIG. 2 shows a schematic diagram of a timepiece according to a preferred embodiment of the invention.

FIG. 2 shows a schematic diagram of an electronic timepiece according to a preferred embodiment of the invention. The timepiece includes, in particular, a time base 1 comprising a quartz oscillator 2 and a frequency division chain associated with a time signal generator forming a unit 3 for delivering first IH1 and second IH2 time-related pieces of information. The first time-related piece of information IH1 corresponds to the local time for the user of the timepiece. The second time-related piece of information IH2 corresponds to a universal time-related piece of information such as for example GMT time (Greewich Median Time), or an "Internet Time". In this regard, U.S. Pat. No. 6,809,993 B1 filed in the name of Swatch AG and titled "Electronic Timepiece including a time related data item based on a decimal system", is incorporated herein by reference particularly as regards the means for generating this universal time-related piece of information based on a decimal system, also called "Internet Time", shown in FIGS. 4 to 6 of this U.S. Patent.

The first time-related piece of information IH1 is provided to display means that can be a liquid crystal display 4 (LCD) and/or an analogue display 5 by means of hands indicating the hours, minutes and possibly the seconds.

The timepiece also includes a control circuit 6 comprising in particular a memory 7, able to contain data relating to a plurality of scheduled events and comparison means 8 receiving at input the second time-related piece of information IH2 compared to the memory-stored data. The data relating to a plurality of scheduled events, stored in memory 7 includes, for each event, the arrival time of the event in a universal time system, GMT or Internet Time, and indications relating to the event.

The stored data can be pre-programmed in memory 7, but they are preferably downloaded by means of an acoustic receiver 9, or a conventional radiofrequency or infrared receiver, from a site of a wide computer network.

The operating detail of an acoustic receiver is given particularly in International Patent Application No. WO 01/09689 filed in the name of the present Applicant and which corresponds to the U.S. National Stage Application No. 10/048,288 that is now U.S. Pat. No. 6,934,521 B1. U.S. Pat. No. 6,934,521 B1 is, incorporated herein by reference particularly as regards the electric diagram of an acoustic signal converter circuit shown in FIG. 3 of the U.S. Patent.

Figure 1:
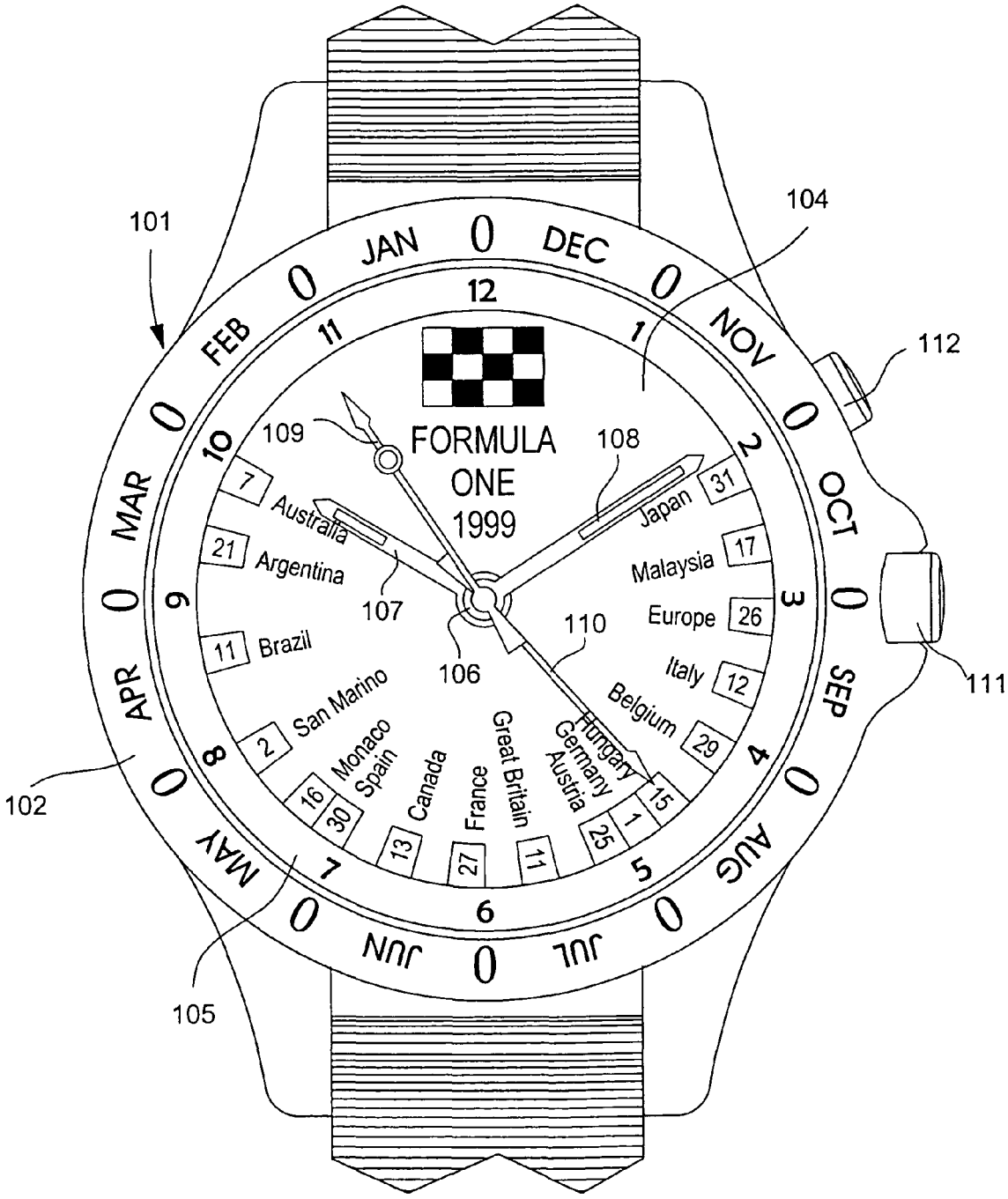
Fig. 1 (PRIOR ART)

The use of such an acoustic receiver for downloading data from a wide computer network site is detailed in European Patent Application No. 01201271.2 filed in the name of Swatch AG and entitled "Method and System for allowing access to information and/or data available on a wide computer networks," and which corresponds to U.S. Patent Application Publication No. US 2002/0152314 A1. This U.S. Patent Application Publication No. US 2002/0152314 A1is incorporated herein by reference, particularly as regards the system of access to this information and/or data shown in FIG. 1 of the Application, as well as the associated access method.

Typically, the data relating to a plurality of scheduled events is grouped together in the form of a file that can be downloaded into memory 7, this file being available on the partner site or sites linked to the plurality of events.

Comparison means 8 allows the second time-related piece of information IH2 to be compared to the arrival time of each event stored in the memory, and in the event of a match, activate indicator means 10 arranged facing indications/symbols 11 (D1 . . . D6) placed on the timepiece dial. It is also possible to arrange for the user to be warned when there is a match to indicate the arrival of one or more events, by activating warning means via comparison means 8, formed for example by a piezoelectric crystal 12.

Figure 3A:
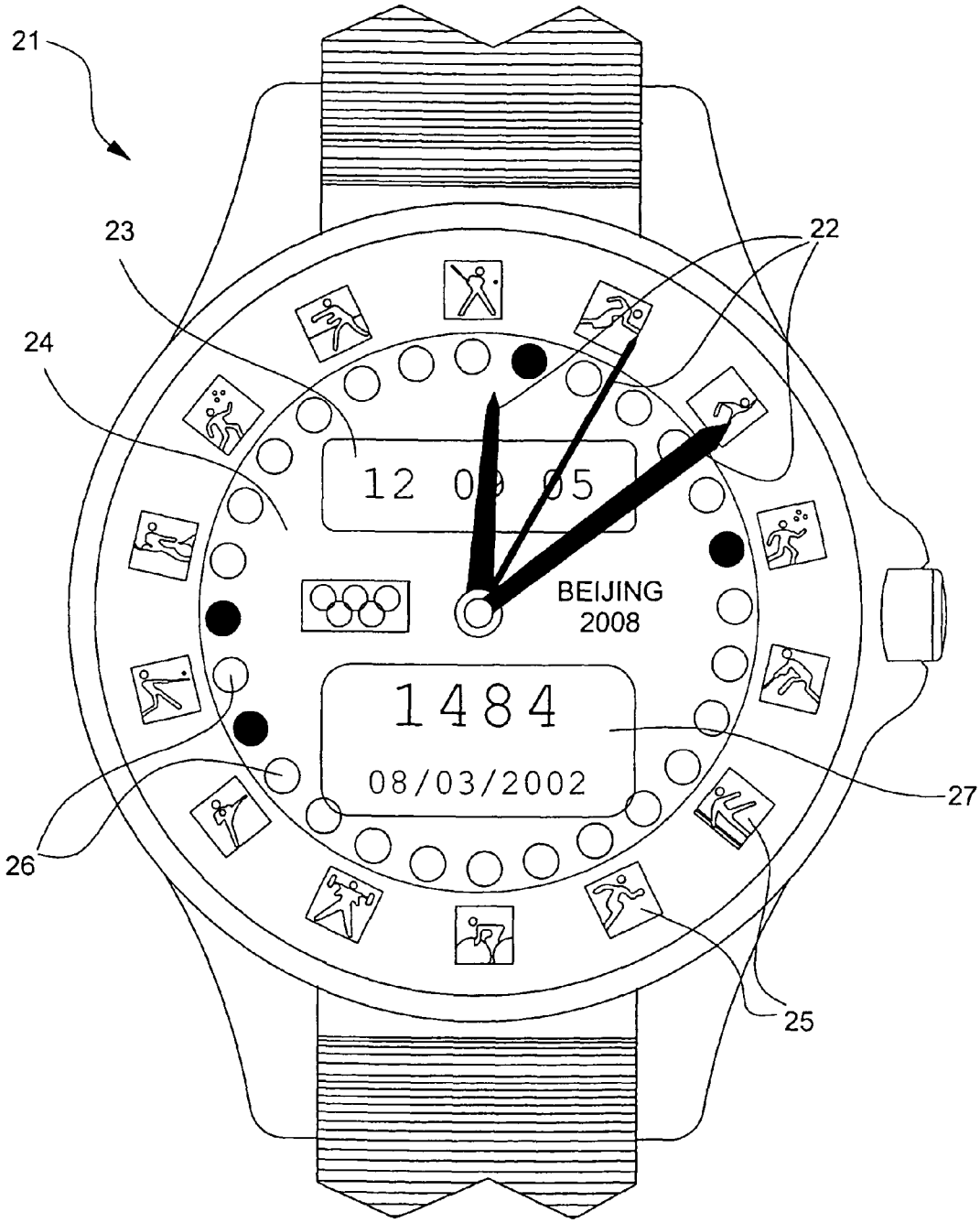
FIGS. 3A and 3B show a timepiece according to first and second variants in accordance with a first embodiment of the invention.
Figure 3B:
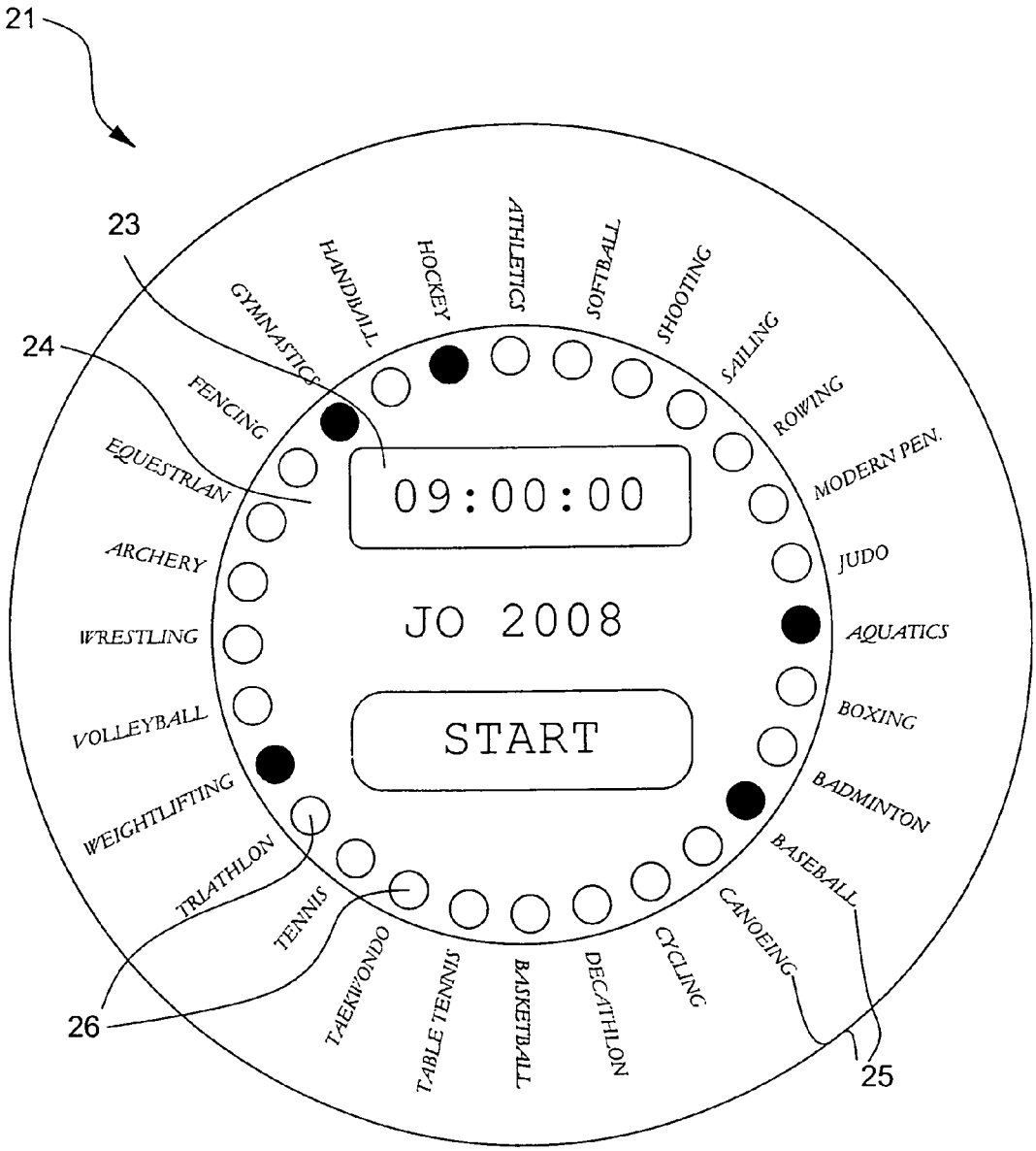

FIGS. 3A and 3B show first and second variants according to a first embodiment of the invention, where the plurality of scheduled events concerns the various competitions occurring during an Olympiad grouped together by discipline. The data relative to this plurality of events is either pre-programmed or downloaded into the timepiece memory.

According to a first variant shown in FIG. 3A, timepiece 21 includes time indicator means including analogue display means 22 and/or digital display means 23, for example of the LCD type. Moreover, dial 24 of the timepiece includes non time-related symbols 25 of the same nature relating to the plurality of events, these symbols 25 preferably being arranged at the periphery of dial 24. In this first embodiment, these symbols represent the different sports disciplines of the Olympic Games.

Dial 24 also includes preferably fixed indicator means 26 that are placed in an annular manner facing symbols 25 representing the disciplines. These indicator means can be for example light emitting diodes or LEDs, shown in the shape of white or black discs. A white disc indicates that the corresponding light emitting diode is switched off or deactivated, conversely a black diode indicates that the corresponding light emitting diode is switched on or activated.

Dial 24 is capable of further including digital display means 27 capable of providing data such as the date and remaining time before the start or finish of the plurality of scheduled events, said plurality of events being connected to each other, within the scope of a larger event such as, for example, the Olympic Games. In a particular embodiment, the timepiece is provided with an RF antenna and means for processing the signals received by the antenna, additional digital display means 27 being then used to display the data obtained by radiofrequency transmission, like for example the site or sites on which the event or events are taking place, or the changing score of the event or events in progress.

In the first variant shown in FIG. 3A, it can be seen that as a function of the memory content and universal time calculated by the internal circuit, indicator means 26 corresponding to symbols 25 of the disciplines in progress are activated-black discs-whatever the local time of the user's geographical position. Indeed, the data relating to the plurality of scheduled events, stored in the memory include as information, the arrival of each of the events in accordance with a universal time, for example Internet Time, and the timepiece includes a time base for generating a universal time-related piece of information of the same type as that used to define the arrival of events. Thus, the comparison between the two pieces of information does not depend upon the local time of the user's geographical position.

According to a second variant of the first embodiment shown in FIG. 3B, timepiece 21 includes digital time display means 23. Unlike the symbols of the first variant of FIG. 3A, dial 24 has non time-related indications 25 of the same nature, relating to the plurality of events. These indications 25 are preferably placed at the periphery of dial 24. These indications represent in this example the various Olympic Games disciplines. Otherwise, the same elements are found again, particularly preferably fixed indicator means 26 placed along a circle facing indications 25 representing the disciplines.

Figure 4:
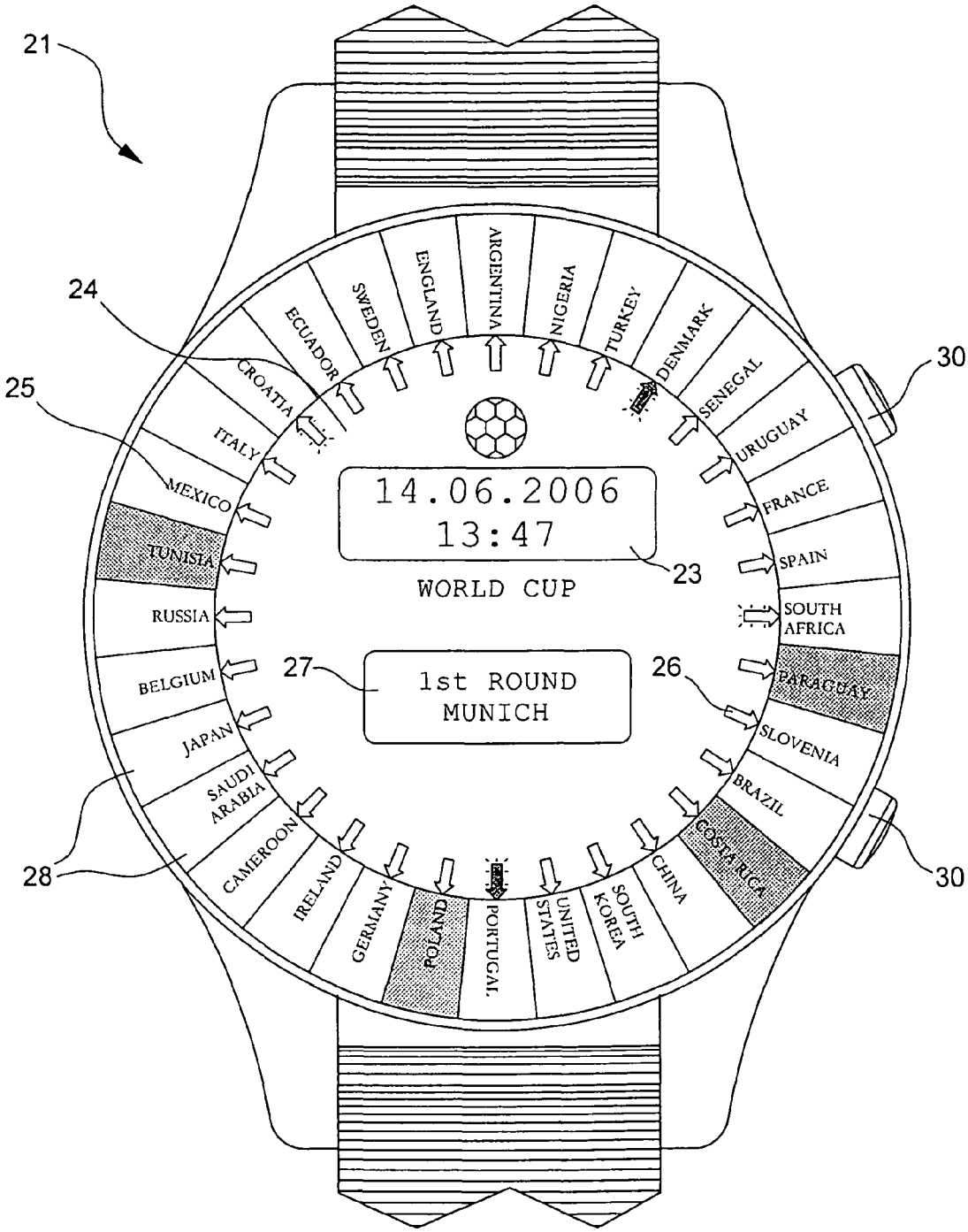
FIG. 4 shows a timepiece according to a second embodiment of the invention.

FIG. 4 shows a second embodiment according to the invention, where the plurality of scheduled events concerns the various countries participating in an international competition of the World Cup type. As all the matches of such a competition are known well in advance, information concerning all the matches, namely the universal time of each match, the name of the teams playing against each other and possibly other information such as the place of the match, are either pre-programmed, or downloaded from a wide computer network site. As regards the matches after certain teams have been eliminated, the result of preceding matches can be downloaded or entered in order to find the matches remaining to be played.

Timepiece 31 includes time indicator means 23, for example of the LCD type. Dial 24 of the timepiece includes non time-related indications 25 of the same nature, relating to the plurality of events. In this second embodiment, these indications 25 represent the various countries participating in the World Cup. It should be noted that one could envisage replacing indications 25 with symbols, like for example, the flags of the various countries.

Dial 24 also includes preferably fixed indicator means 26 placed along a circle facing indications 25 representing the countries. These indicator means can be for example light emitting diodes or LEDs, shown as white or black arrows in the drawing. A white arrow indicates that the corresponding light emitting diode is switched off or deactivated, a black arrow indicates that the corresponding light emitting diode is switched on or activated, the white and black arrows surrounded by dots indicate that the corresponding light emitting diodes are flashing to be able to indicate alternately the name of the different teams playing at the same time, in particular when two matches occur at the same time.

Dial 24 further includes means for masking non time-related indications 25 that has become unnecessary, for example the countries whose national teams have been eliminated from the competition. These means for masking indications 25 preferably include a reflective liquid crystal cell arranged between dial 24 and the glass, not shown, of timepiece 21. This cell includes appropriately addressed segments 28. Depending upon whether the national team of the countries indicated on indications 25 has been eliminated or not, reflective segments 28 are respectively controlled to let the light through, the remaining country then visible, or to not allow the light through, the country then being masked.

Dial 24 can further include digital display means 27 for providing information such as the state of play of the competition and the place of the match in progress.

Moreover, the timepiece includes control members 30 for entering data like the results of matches already played, in order to allow data relating to the plurality of events, stored in the timepiece memory to be updated. It is also possible to download this data directly from a specific site of a wide computer network.

Figure 5:
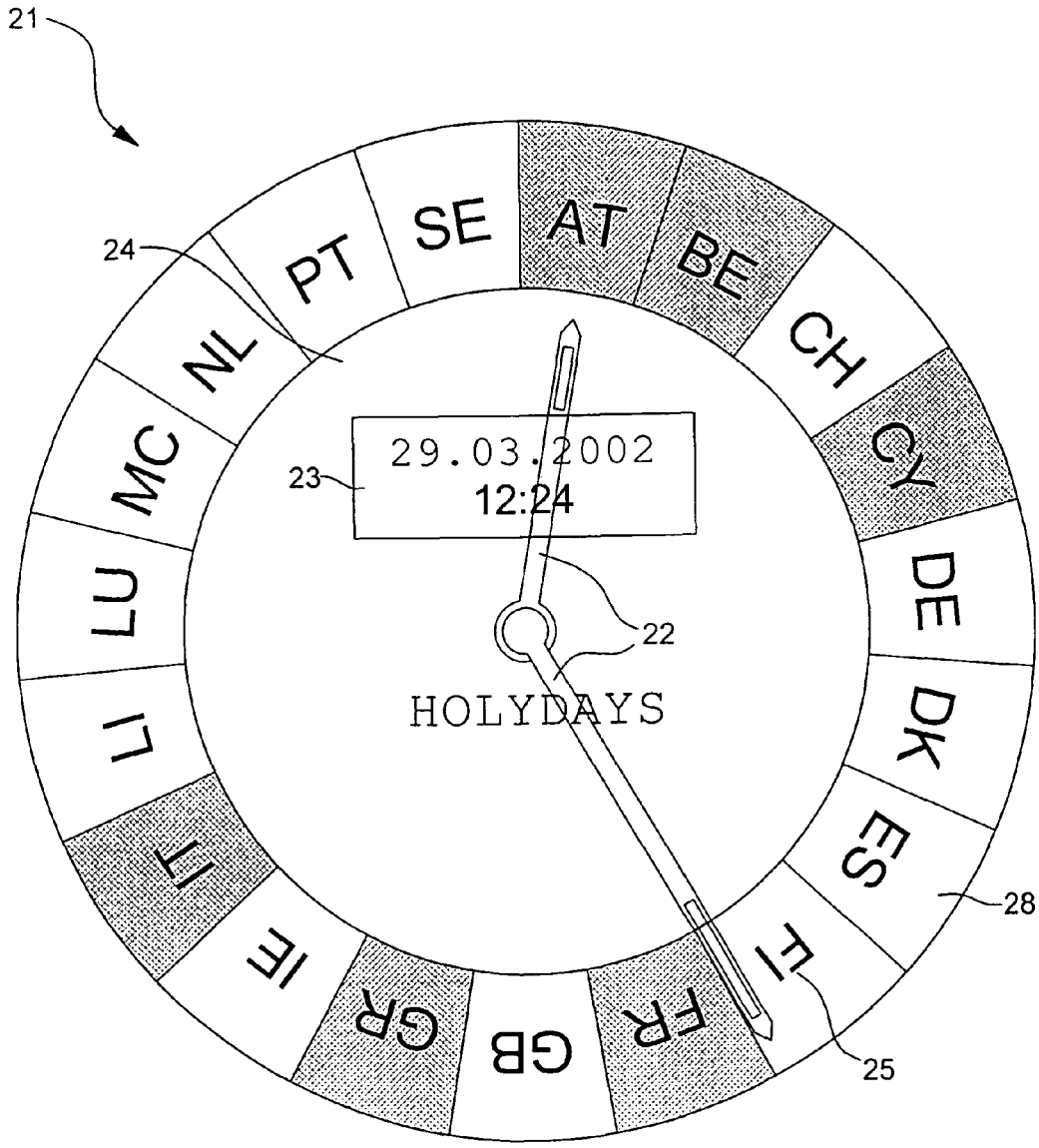
FIG. 5 shows a timepiece according to a third embodiment of the invention.

FIG. 5 shows a third embodiment according to the invention, where the plurality of scheduled events concerns the different public holidays of a year for a certain number of countries that can be selected. Data relating to this plurality of scheduled events is either pre-programmed, or downloaded into the timepiece memory.

Timepiece 21 includes time indicator means including analogue display means 22 and/or digital display means 23, for example of the LCD type. Moreover, preferably a reflective liquid crystal cell is arranged at the periphery of timepiece dial 24. This cell includes appropriately addressed segments 28, capable of displaying, as a function of the data stored in the memory, non time-related indications and/or symbols 25, not shown, of the same nature relating to the plurality of events. In this third embodiment, indications 25 represent the two-letter code for the contracting states to the European Patent Convention. When segments 28 let the light pass, they display the two letter codes, and when they do not let the light pass, they mask these codes.

It should be noted, by way of variant, that it is also possible to use a liquid crystal display screen arranged above the dial and in particular above the periphery of the dial, and to define the zones that have to let light pass and thus leave the indications that have to be displayed in these zones visible, and the zones that do not have to let the light pass and thus mask the indications corresponding to these zones.

Figure 6:
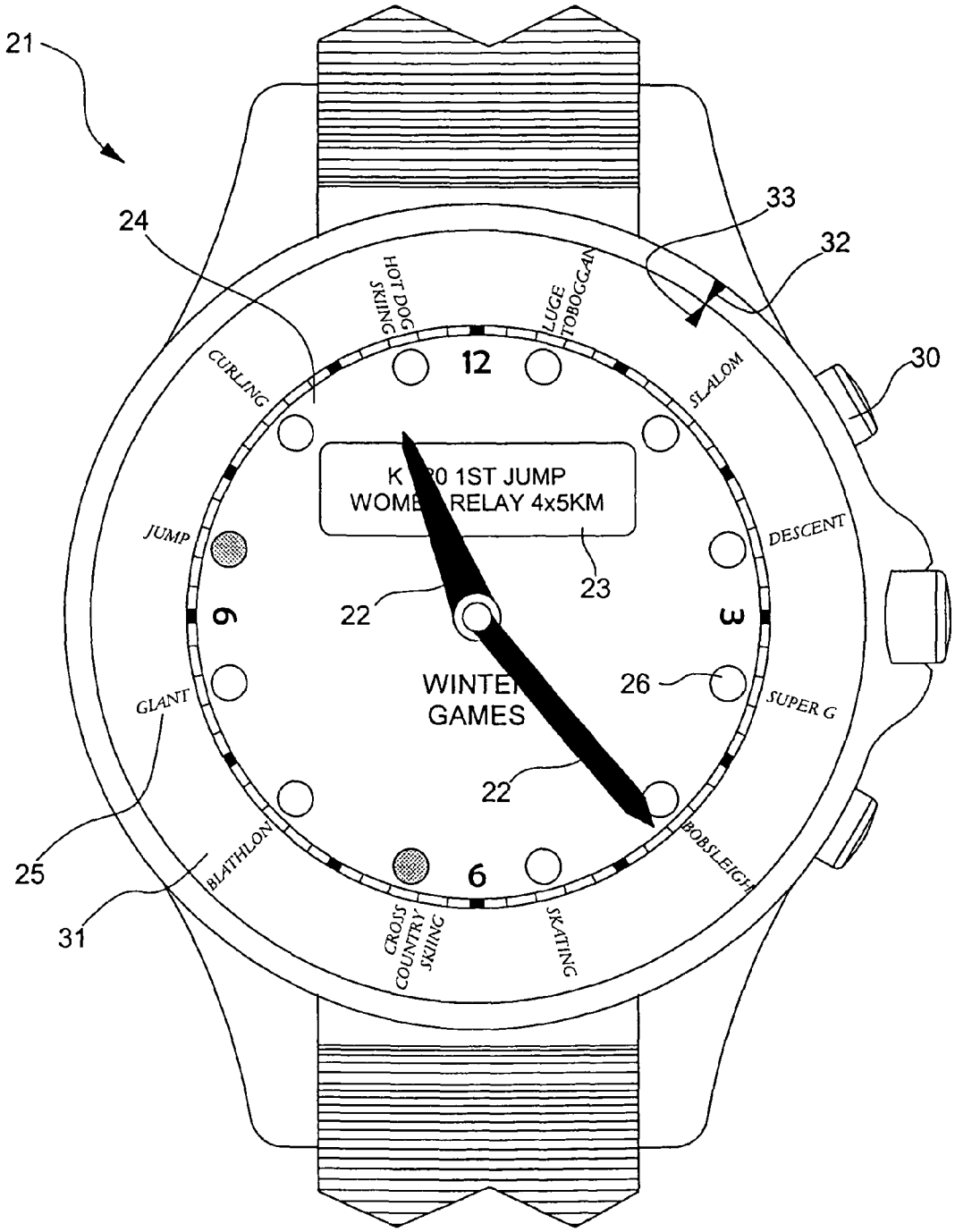
FIG. 6 shows a timepiece according to a fourth embodiment of the invention.

According to a fourth advantageous embodiment of the invention, shown in FIG. 6, non time-related indications and/or symbols 25 of the same nature relating to a plurality of scheduled events are arranged not on dial 24 of timepiece 21, but on bezel 31. Preferably, a removable bezel is used allowing indications and/or symbols 25 to be changed during reprogramming or during downloading of a new plurality of scheduled events. Indeed, it is preferable and largely economical to be able to modify these indications or symbols 25 simply by changing bezel 31, instead of having to change watch, or change dial, or have a timepiece provided with programmable indications or symbols that can be displayed with a liquid crystal cell. In order to properly position the new removable bezel when it is being changed, it will be noted that the timepiece case is provided, for example, with a foolproof device, for example a triangular mark 32, to which a similar mark 33 corresponds on the new bezel. It will also be noted that digital display means 23 can be used to specify the discipline competitions corresponding to the events in progress.

Finally, it is important to note that the display of the event or events in progress from among the plurality of events concerned, whatever the embodiment, can be achieved either continuously, or, for the sake of saving energy, only after a control member of the pushbutton, crown, tactile glass, etc. type has been activated.

Moreover, additional functions could be integrated such as a countdown to an event, interrogation of the scheduled events, etc.

It is also important to note that all combinations of the aforementioned features, and in particular time and non time-related indicator means, are possible without thereby departing from the scope of the invention defined by the annexed claims.

The invention claimed is:

1. An electronic timepiece, including:

a time base connected to deliver a first time-related piece of information to first indicator means for said first time-related piece of information and connected to deliver a second time-related piece of information to a control circuit;

non time-related indications/symbols of the same nature relating to a plurality of scheduled events, connected to each other;

second indicator means capable of simultaneously designating several non time-related indications/symbols relating to one or more events occurring from among said plurality of scheduled events, wherein the control circuit includes storage means in which data is stored relating to the scheduling of said plurality of events and comparison means for comparing said stored data with the second time-related piece of information, said control circuit connected to activate said second indicator means in response to a control signal from said comparison means.

2. The electronic timepiece according to claim 1, wherein said second indicator means are formed by a plurality of fixed indicators, each indicator corresponding to one of said non time-related indications/symbols.

3. The electronic timepiece according to claim 2, wherein said non time-related indications/symbols are arranged at the periphery of a dial and in that said fixed indicators are light emitting diodes arranged in a ring facing said indications/symbols.

4. The electronic timepiece according to claim 2, wherein said non time-related indications/symbols are arranged at the periphery of a dial and in that said fixed indications are formed by a liquid crystal cell including a plurality of segments arranged in a ring above said indications/symbols.

5. The electronic timepiece according to claim 2, wherein said non time-related indications/symbols are arranged on a removable bezel and in that said fixed indicators are light emitting diodes arranged in a ring facing said indications/symbols.

6. The electronic timepiece according to claim 1, wherein said non time-related indications/symbols are arranged at the periphery of a dial and in that said second indicator means are formed by a liquid crystal cell arranged above the dial, capable of masking or leaving visible each of said indications/symbols.

7. The electronic timepiece according to claim 1, wherein said time base delivers a second universal time-related piece of information, and in that said plurality of events is scheduled as a function of this second time-related piece of information.

8. The electronic timepiece according to claim 7, further including warning means to alert a user that one or several events from among said plurality of scheduled events are starting.

9. The electronic timepiece according to claim 7, further including means for receiving external signals for loading said data relating to the scheduling of said plurality of events.

10. The electronic timepiece according to claim 7, further including control members for activating said second indicator means corresponding to one or more events in progress from among said plurality of scheduled events.

11. The electronic timepiece according to claim 7, further including countdown means for indicating the time remaining until an event.

12. The electronic timepiece according to claim 1, further including means for receiving external signals for loading said data relating to the scheduling of said plurality of events.

13. The electronic timepiece according to claim 12, wherein said reception means are means for receiving modulated acoustic signals and in that the data relating to the scheduling of said plurality of events is loaded from a specific site of a wide computer network.

14. The electronic timepiece according to claim 1, further including control members for activating said second indicator means corresponding to one or more events in progress from among said plurality of scheduled events.

15. The electronic timepiece according to claim 14, wherein the timepiece includes a continuous operating mode during which said second indicator means corresponding to one or more events in progress from among said plurality of events are activated and deactivated automatically, respectively, at the beginning or at the end of each event.

16. The electronic timepiece according to claim 1, further including countdown means for indicating the time remaining until an event.

* * * * *